US006402379B1

(12) United States Patent
Albright

(10) Patent No.: US 6,402,379 B1
(45) Date of Patent: Jun. 11, 2002

(54) BAG WITH ARCUATE-TRANSITION TEAR LINE

(75) Inventor: Timothy L. Albright, High Point, NC (US)

(73) Assignee: Rex International Incorporated, Thomasville, NC (US)

( * ) Notice: Subject to any disclaimer, the term of this patent is extended or adjusted under 35 U.S.C. 154(b) by 0 days.

(21) Appl. No.: 09/858,984

(22) Filed: May 16, 2001

(51) Int. Cl.[7] ..... B65D 65/28
(52) U.S. Cl. ..... 383/209; 383/906
(58) Field of Search ..... 383/209, 906

(56) References Cited

U.S. PATENT DOCUMENTS

| | | | | | |
|---|---|---|---|---|---|
| 3,397,835 | A | * | 8/1968 | Henning | 383/209 |
| 4,903,839 | A | * | 2/1990 | Mattiebe et al. | 206/554 |
| 4,966,286 | A | * | 10/1990 | Muchenfuhs | 383/209 |
| 5,558,438 | A | * | 9/1996 | Warr | 383/209 |
| 5,593,229 | A | | 1/1997 | Warr | |
| 5,601,369 | A | * | 2/1997 | Moseley et al. | 383/209 |
| 5,611,626 | A | | 3/1997 | Warr | |
| 5,702,339 | A | * | 12/1997 | Smiley | 493/196 |
| 6,231,232 | B1 | | 5/2001 | Warr | |

* cited by examiner

*Primary Examiner*—Stephen P. Garbe
(74) *Attorney, Agent, or Firm*—Adams, Schwartz & Evans, P.A.

(57) ABSTRACT

A bag includes first and second polyolefin walls with a thickness of between 3 and 12 mils. The bag has joined opposing side edges, opposing end edges, and at least one seal line proximate one of the end edges. The seal line extends laterally from one side edge to the other for sealing closed an end of the bag. The improvement in the bag is a perforated tear line defining an easy-open corner portion of the bag removable to form a pourer. The perforated tear line includes a vertical segment defined by a series of closely spaced perforations formed in the first and second walls of the bag and closer to one side edge of the bag than the other. The vertical segment extends in a straight path outwardly from the seal line and generally parallel to the closer side edge of the bag. An arcuate transition segment of perforations begins at an end of the vertical segment and extends in an arcuate path towards the closer side edge of the bag. A diagonal segment of perforations extends along a straight incline from an end of the arcuate transition segment towards the closer side edge of the bag. The vertical segment, arcuate transition segment, and diagonal segment cooperate to enable the corner portion of the bag to be torn in a progressive tearing motion to form a hole in the bag from which the contents can be poured.

16 Claims, 6 Drawing Sheets

BAG WITH ARCUATE-TRANSITION TEAR LINE

TECHNICAL FIELD AND BACKGROUND OF THE INVENTION

This invention relates generally to heavy duty plastic bags made from single or multi-ply polyolefin materials, such as LD, HD, and LLD polyethylene and polypropylene, as well as other woven or nonwoven, synthetic or non-synthetic materials. Such bags are typically used to package materials such as fiberglass insulation, salt, potting soil, small landscaping rocks, pet food and similar heavy materials. While the invention has particular application to bags with a capacity of from 20 to 100 pounds, the principle of the invention is applicable to bags of any size.

Conventional, heavy-duty bags of the prior art are typically cut along the top with a knife or other suitable tool to define a sufficiently large opening through which the contents of the bag are dispensed. In the absence of a cutting knife or tool, attempts to manually tear open the bag by hand are often futile, because of the relative thickness and durability of such bags. Once opened, the bag must generally be embraced with both arms, lifted and inverted to dispense the contents from an opening in or near the top of the bag. In many cases, this requires substantial physical effort, and sometimes results in inadvertent uncontrolled dumping or over-dumping of the contents.

Applicant's prior issued U.S. Pat. No. 5,593,229 describes a heavy duty bag with an easily-removable corner adapted for being hand-torn to form a hole for pouring contents from the bag. The preferred embodiments of the bag described in the '229 Patent include a perforated vertical tear line extending downwardly from a top end edge of the bag to a second tear line extending from the first tear line towards the near side edge of the bag. While this bag solved many problems of the prior art, certain disadvantages and limitations still existed. Principally, the corner of the bag remained relatively difficult to tear by hand at the junction of the first and second tear lines in the case of a diagonally extending second tear line, and along the entire length of the second tear line in the case an arcuate line. Where the second tear line extended diagonally towards the near side edge of the bag, the difficulty in tearing resulted from the lack of a smooth transition from the first tear line to the second tear line. The bag with the arcuate second tear line provided a better transition from the vertical first tear line, but required greater effort to remove the torn corner due to the formation of perforations directly against the machine direction of the bag.

SUMMARY OF THE INVENTION

Therefore, it is an object of the invention to provide a bag with an improved easy-open corner portion.

It is another object of the invention to provide a bag with a perforated tear line including one or more arcuate transition segments to facilitate tearing the bag along a predetermined path.

It is another object of the invention to provide a bag with a perforated tear line which includes relatively few perforations formed against, or generally perpendicular to, the machine direction of the bag; the "machine direction" being a direction extending longitudinally from one end edge of the bag to the other.

These and other objects of the present invention are achieved in the preferred embodiments disclosed below by providing an improved bag including first and second polyolefin walls with a thickness of between 3 and 12 mils. The bag has joined opposing side edges, opposing end edges, and at least one seal line proximate one of the end edges. The seal line extends laterally from one side edge to the other for sealing closed an end of the bag. The improvement in the bag is a perforated tear line defining an easy-open corner portion of the bag removable to form a pourer. The perforated tear line includes a vertical segment defined by a series of closely spaced perforations formed in the first and second walls of the bag and closer to one side edge of the bag than the other. The vertical segment extends in a straight path outwardly from the seal line and generally parallel the closer side edge of the bag. An arcuate transition segment of perforations begins at an end of the vertical segment and extends in an arcuate path towards the closer side edge of the bag. A diagonal segment of perforations extends along a straight incline from an end of the arcuate transition segment towards the closer side edge of the bag. The vertical segment, arcuate transition segment, and diagonal segment cooperate to enable the corner portion of the bag to be torn in a progressive tearing motion to form a hole in the bag from which the contents can be poured.

According to another preferred embodiment of the invention, the perforations of the tear line are between 1/16th inch and 3/8th inch long.

According to another preferred embodiment of the invention, the perforations of the tear line are between 1/16th inch and 3/8th inch apart from adjacent perforations.

According to another preferred embodiment of the invention, the arcuate transition segment of the tear line is less than 20 percent of the overall length of the tear line.

According to another preferred embodiment of the invention, the arcuate transition segment of the tear line defines a radius of approximately 2 inches.

According to another preferred embodiment of the invention, the diagonal segment of the tear line extends from the arcuate transition segment at an angle less than 60 degrees to the closer side edge of the bag.

According to another preferred embodiment of the invention, the diagonal segment of the tear line extends from the arcuate transition segment at a 45 degree angle to the closer side edge of the bag.

According to another preferred embodiment of the invention, the tear line has a second arcuate transition segment of perforations beginning at an end of the diagonal segment and extending in an arcuate path towards the closer side edge of the bag.

According to another preferred embodiment of the invention, the tear line has a horizontal segment of perforations beginning at an end of the second arcuate transition segment and extending in an arcuate path towards the closer side edge of the bag.

According to another preferred embodiment of the invention, the first and second arcuate transition segments of the tear line each define a radius of approximately 1 inch.

According to another preferred embodiment of the invention, a second seal line is spaced-apart from the first seal line and extends laterally from one side edge of the bag to the other. A handle is formed in an area between the two spaced-apart seal lines.

According to another preferred embodiment of the invention, the handle is a generally U-shaped, die-cut slit.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
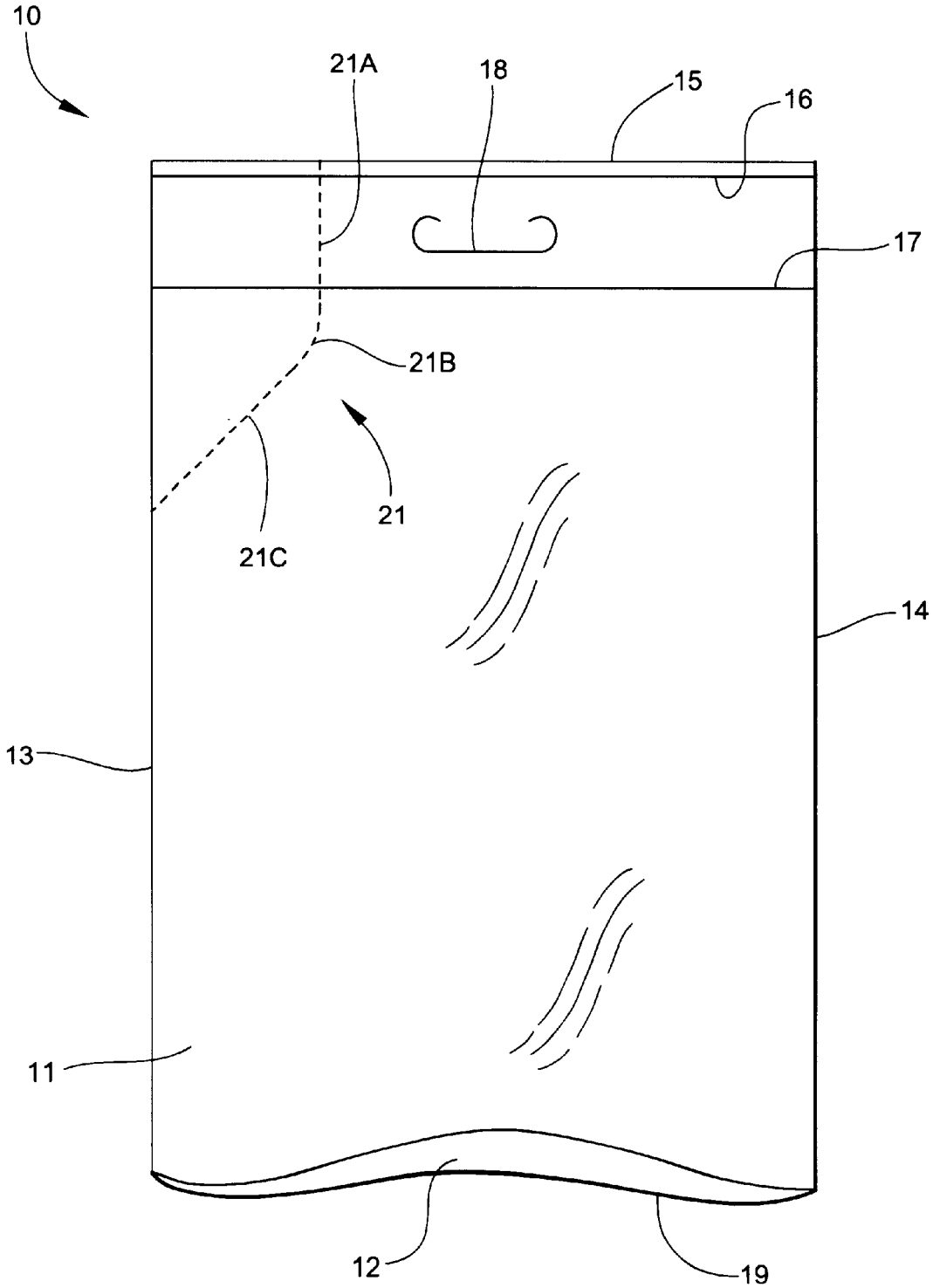
FIG. 1 is a view of a heavy-duty thermoplastic bag according to one preferred embodiment of the invention, and showing the bag prior to filling.

Referring now specifically to the drawings, a bag according to the present invention is illustrated in FIG. 1 and shown generally at reference numeral 10. Bags of the type disclosed are used for heavy-duty applications, such as for transport, sale, and storage of materials such as fiberglass insulation, salt, fertilizer, lawn lime, potting soil, and the like. The bags are typically fabricated from a polyolefin sheet or tube stock such as polyethylene or polypropylene having a thickness in the range of 3 to 12 mils. The sheet or tube stock may be coextruded or monoextruded, and may be single ply or multi-ply material. The multi-ply material may be multiple thicknesses of the same sheet or tube stock, or different materials to provide particular characteristics, such as strength, flexibility, UV resistance, or color. The sheet stock may also be woven or non-woven synthetic or non-synthetic material.

Bag 10 is formed from thermoplastic sheet or tube stock, and has overlying front and back walls 11 and 12, defining opposing joined side edges 13 and 14. The term "joined" is used in a broad sense to mean either two formerly separate sheets connected together, or integrally formed by, for example, folding over a sheet to define an edge. For purposes of example and illustration, bag 10 is a flat tube-type bag. However, bags incorporating the present invention may be fabricated in a side-gusset tube style, flat tube back-seamed style, side gusset back seam style, or any other suitable bag design.

Figure 2:
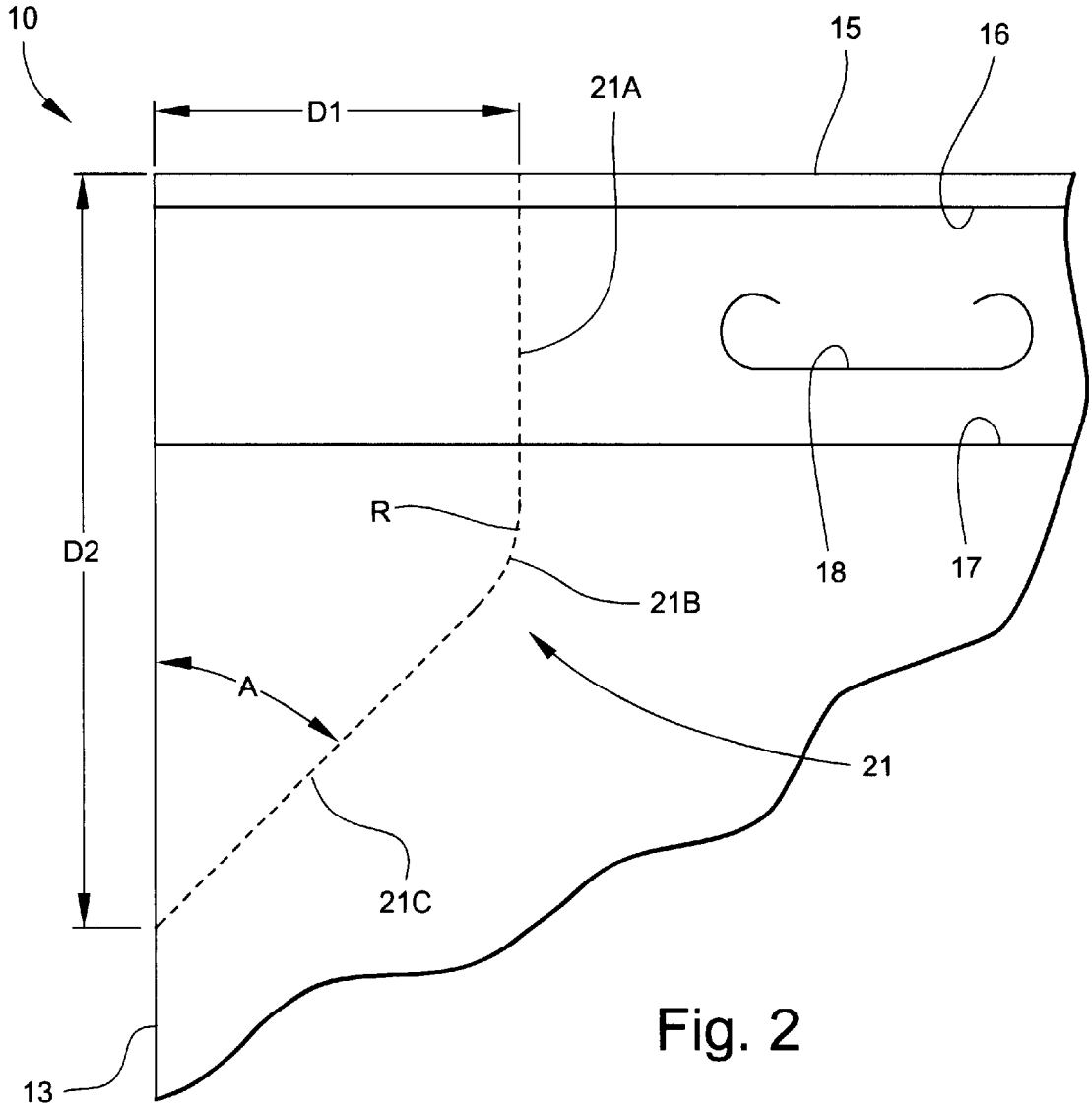
FIG. 2 is an enlarged, fragmentary view showing a corner portion of the bag.
Figure 3:
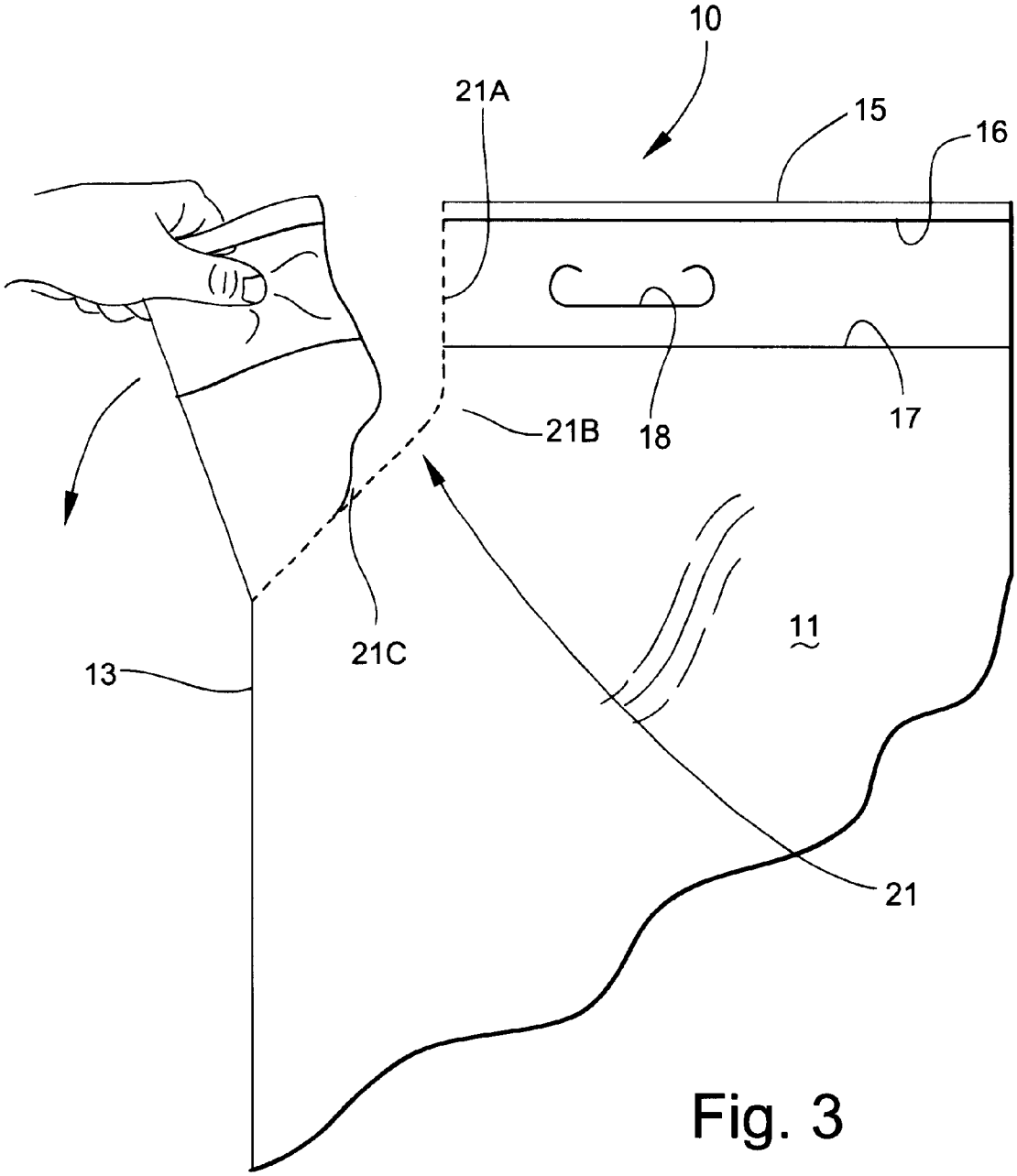
FIG. 3 is a fragmentary view of the bag showing the corner portion of the bag being removed.

The thermoplastic walls 11 and 12 are connected together proximate the top end edge 15 of the bag 10 by a lateral seal line 16 extending from side edge 13 to side edge 14. The seal line 16 is formed by adhesive, sewing, ultrasonic heating, or other heat-fusing process. In the embodiment of FIGS. 1–3, a second seal line 17 is formed below the first seal line 16 and defines the upper closure of the contents-holding portion of the bag 10. A generally U-shaped slit 18 is die-cut into the area between the seal lines 16 and 17 to form a carry handle when the hand is extended through the slit 18. The bottom end edge 19 of the bag 10 remains open for filling.

As best shown in FIG. 2, the bag 10 includes a line 21 of closely-spaced perforations formed in each of the walls 11 and 12, and defining an easy-open corner portion of the bag 10 removable by hand to form a pourer. The perforated tear line 21 includes a vertical segment 21A extending in a straight path downwardly from the top end edge 15 of the bag 10 and generally parallel to the closer side edge 13. An arcuate transition segment 21B begins at an end of the vertical segment 21A and extends in a generally concave arcuate path towards the closer side edge 13 of the bag 10. The arc radius "R" of this segment 21B is preferably about 2 inches. Finally, a diagonal segment 21C is formed along a straight incline from an end of the arcuate transition segment 21B to the closer side edge 13. The diagonal segment 21C extends at an angle "A" of 45 degrees relative to the side edge 13. According to this embodiment, the overall length of the tear line 21 is 10.8 inches with the arcuate transition segment 21B comprising approximately 14 percent of this length; the length of the vertical segment 21A being 3.7 inches, the arcuate transition segment 21B being 1.5 inches, and the diagonal segment 21C being 5.5 inches. The lateral distance "D1" from the side edge 13 of the bag 10 to a top end of the perforated tear line 21 is 4.5 inches. The vertical distance "D2" from the top end edge 15 of the bag 10 to the bottom end of the tear line 21 is 9 inches.

As shown in FIG. 3, the bag 10 is opened by gripping the top end edge 15 and pulling the bag 10 apart on opposite sides of the tear line 21. A progressive tearing motion starts at the top end of the tear line 21 and extends into the vertical segment 21A causing the lands between the perforations to rupture. The tear extends down the vertical segment 21A and then into the arcuate transition segment 21B. Because of the curved pattern of perforations in the arcuate transition segment 21B, the tear easily transitions into the diagonal segment 21C with relatively little added physical effort, and without deviating from the predetermined path defined by the tear line 21. From the transition segment 21B, the tear extends at an incline along the diagonal segment 21C to the side edge 13 of the bag 10. The corner portion is thus completely severed from the bag 10. A pourer is formed in the corner of the bag 10 through which the contents can be poured. Material can be poured from the bag 10 with complete visibility and without diverting the flow of material, because the bag material severed to form the opening is completely removed and discarded.

Figure 4:
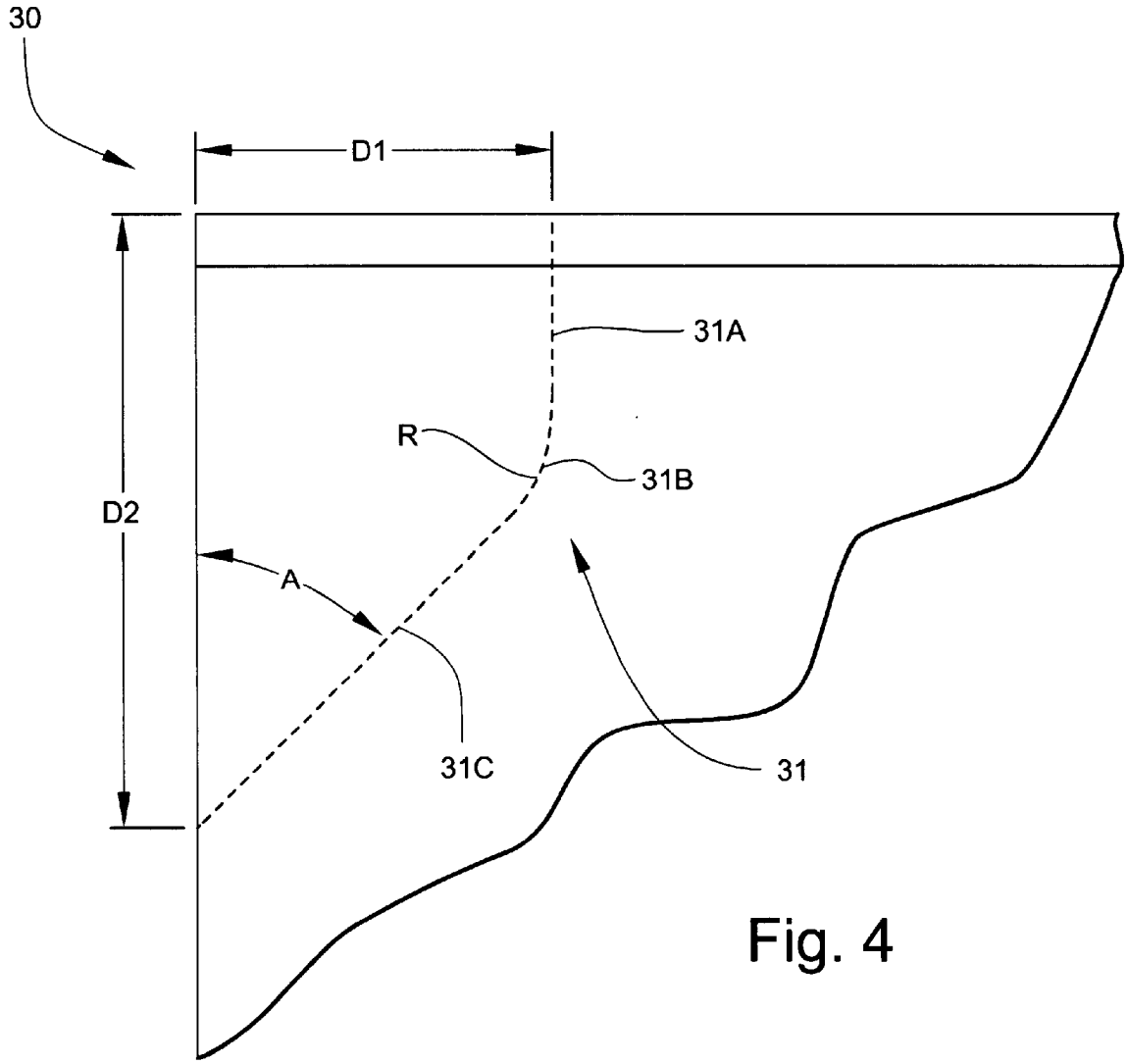
FIG. 4 is an enlarged, fragmentary view showing a corner portion of a bag according to a second preferred embodiment of the invention.
Figure 5:
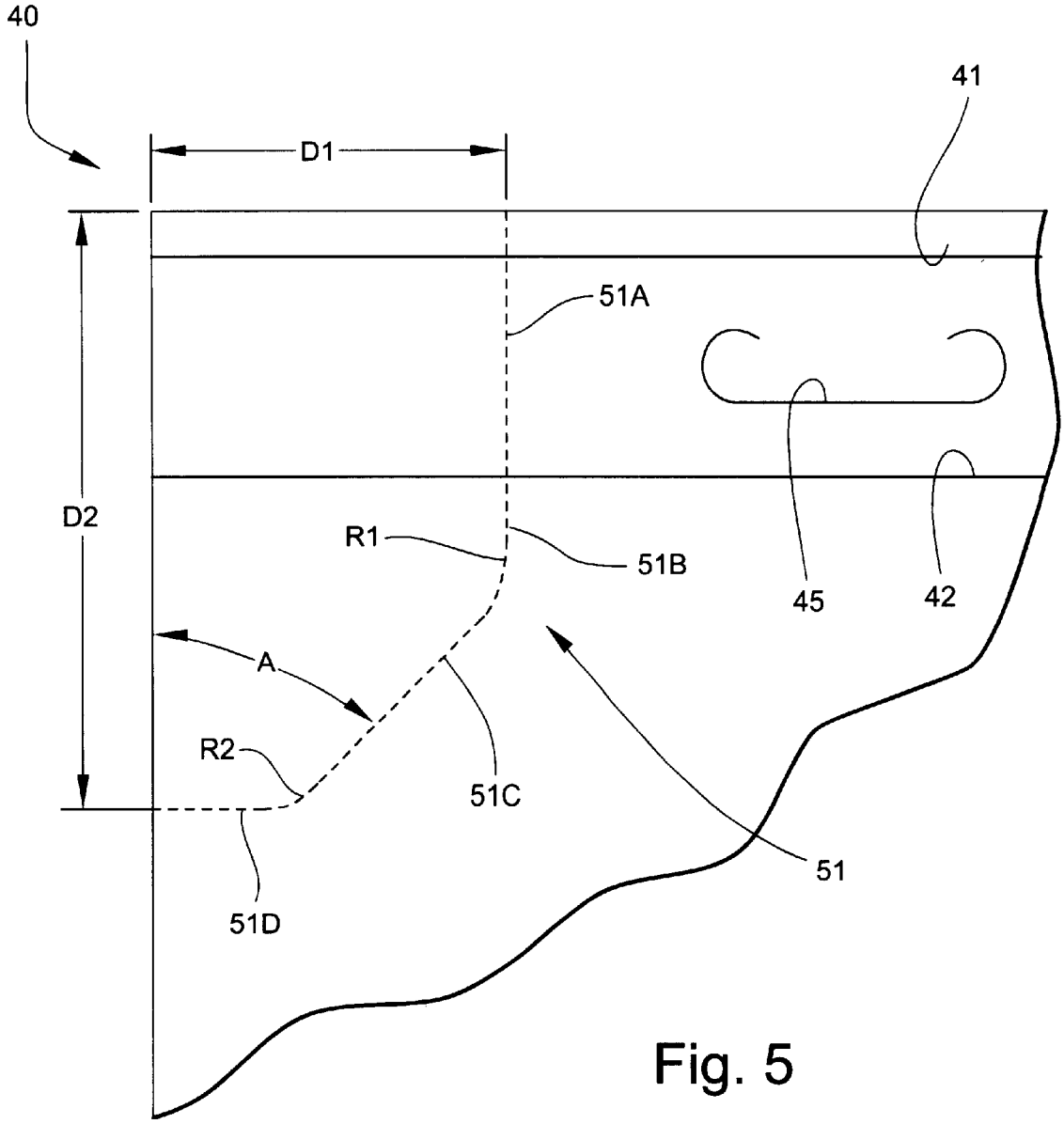
FIG. 5 is an enlarged, fragmentary view showing a corner portion of a bag according to a third preferred embodiment of the invention.
Figure 6:
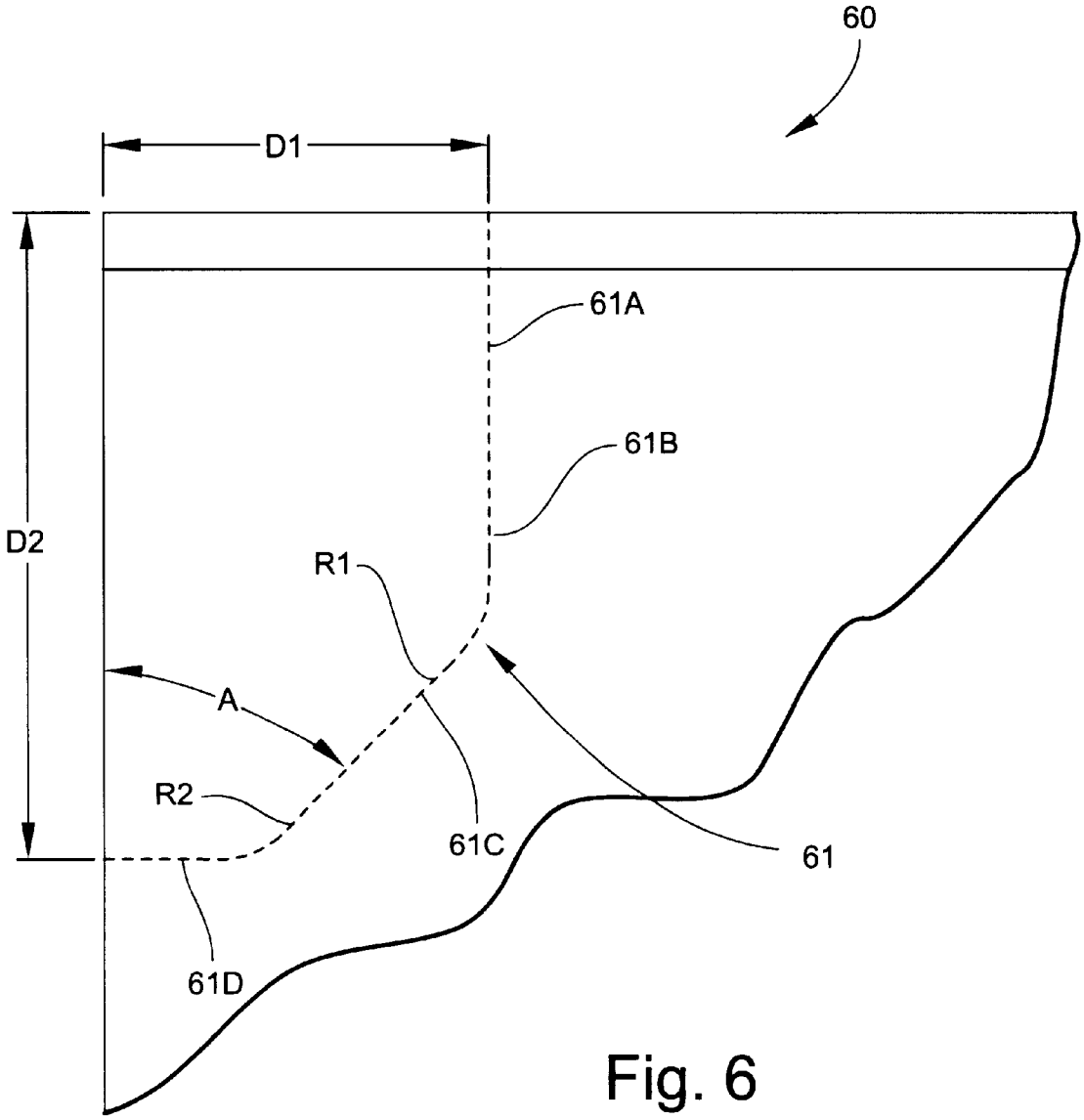
FIG. 6 is an enlarged, fragmentary view showing a corner portion of a bag according to a fourth preferred embodiment of the invention.

Further embodiments of the invention are illustrated in FIGS. 4–6. FIG. 4 shows a bag 30 similar to the bag 10, but without a second seal line or handle. Bag 30 includes a line of closely-spaced perforations 31 formed in each of the bag walls, and defining an easy-open corner portion of the bag 30 removable by hand to form a pourer. The perforated tear line 31 includes a vertical segment 31A extending in a straight path downwardly from the top end edge of the bag 30 and generally parallel to the closer side edge. An arcuate transition segment 31B begins at an end of the vertical segment 31A and extends in a generally concave arcuate path towards the closer side edge of the bag 30. The arc radius "R" of this segment 31B is preferably about 2 inches. A diagonal segment 31C is formed along a straight incline from an end of the arcuate transition segment 31B to the closer side edge. The diagonal segment 31C extends at an angle "A" of 45 degrees relative to the side edge. The overall length of the tear line 31 is 9.1 inches with the arcuate transition segment 31B comprising approximately 17 percent of this length; the length of the vertical segment 31A being 2.0 inches, the arcuate transition segment 31B being 1.6 inches, and the diagonal segment 31C being 5.5 inches. The lateral distance "D1" from the side edge of the bag 30 to atop end of the perforated tear line 31 is 4.5 inches. The vertical distance "D2" from the top end edge of the bag 30 to the bottom end of the tear line 31 is 7.3 inches.

The bag 40 shown in FIG. 5 includes first and second spaced apart seal lines 41 and 42, and a die-cut handle 45 formed between the seal lines. A line of closely-spaced perforations 51 is formed in each of the bag walls, and defines an easy-open corner portion of the bag 40 removable by hand to form a pourer. The perforated tear line 51 includes a vertical segment 51A extending in a straight path downwardly from the top end edge of the bag 40 and generally parallel to the closer side edge. A first arcuate transition segment 51B begins at an end of the vertical segment 51A and extends in a generally concave arcuate path towards the closer side edge of the bag 40. The arc radius "R" of this segment 51B is preferably about 1 inch. A diagonal segment 51C is formed along a straight incline from an end of the first arcuate transition segment 51B to a second arcuate transition segment 51D. The diagonal segment 51C extends at an angle "A" of 45 degrees relative to the side edge. The arc radius "R2" of the second transition segment 51D is also about 1 inch. Finally, a relatively short horizontal segment 51E extends from the second arcuate transition segment 51D to the side edge of the bag 40. The overall length of the tear line 51 is 9.8 inches with the first and second arcuate transition segments 51B, 51D comprising approximately 16 percent of this length; the length of the vertical segment 51A being 3.9 inches, the first arcuate transition segment 51B being 0.8 inches, the diagonal segment 51C being 3.0 inches, the second arcuate transition segment 51D being 0.8 inches, and the horizontal segment 51E being 1.3 inches. The lateral distance "D1" from the side edge of the bag 40 to a top end of the perforated tear line 51 is 4.5 inches. The vertical distance "D2" from the top end edge of the bag 40 to the bottom end of the tear line 51 is 7.0 inches.

FIG. 6 shows a bag 60 similar to the bag 40 of FIG. 5, but without a second seal line or handle. A line of closely-spaced perforations 61 is formed in each of the bag walls, and defines an easy-open corner portion of the bag 60 removable by hand to form a pourer. The perforated tear line 61 includes a vertical segment 61A extending in a straight path downwardly from the top end edge of the bag 60 and generally parallel to the closer side edge. A first arcuate transition segment 61B begins at an end of the vertical segment 61A and extends in a generally concave arcuate path towards the closer side edge of the bag 60. The arc radius "R1" of this segment 61B is preferably about 1 inch. A diagonal segment 61C is formed along a straight incline from an end of the first arcuate transition segment 61B to a second arcuate transition segment 61D. The diagonal segment 61C extends at an angle "A" of 45 degrees relative to the side edge. The arc radius "R2" of the second transition segment 61D is also about 1 inch. A relatively short horizontal segment 61E extends from the second arcuate transition segment 61D to the side edge of the bag 60. The overall length of the tear line 61 is 9.1 inches with the first and second arcuate transition segments 61B, 61D comprising approximately 17 percent of this length; the length of the vertical segment 61A being 3.1 inches, the first arcuate transition segment 61B being 0.8 inches, the diagonal segment 61C being 3.0 inches, the second arcuate transition segment 61D being 0.8 inches, and the horizontal segment 61E being 1.4 inches. The lateral distance "D1" from the side edge of the bag 60 to a top end of the perforated tear line 61 is 4.5 inches. The vertical distance "D2" from the top end edge of the bag 60 to the bottom end of the tear line 61 is 6.3 inches.

For each of the bags described above, the length of each perforation is approximately 0.1 inch. The length of the lands between perforations is approximately 0.25 inch. To facilitate tearing, the perforations at each end of the tear line preferably communicate with the top end edge of the bag and side edge, respectively.

A bag with an arcuate-transition tear line is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

I claim:

1. In a bag including first and second walls having joined opposing side edges, opposing end edges, and at least one seal line proximate one of said end edges and extending laterally from one side edge to the other for sealing closed an end of the bag, the improvement comprising a perforated tear line defining an easy-open corner portion of the bag removable to form a pourer, said perforated tear line comprising:

(a) a vertical segment defined by a series of closely spaced perforations formed in said first and second walls of said bag and closer to one side edge of said bag than the other, said vertical segment extending in a straight path outwardly from said seal line and generally parallel to the closer side edge of said bag;

(b) a first arcuate transition segment defined by a series of closely spaced perforations formed in said first and second walls of said bag, and beginning at an end of said vertical segment and extending in an arcuate path towards the closer side edge of said bag; and (c) a diagonal segment defined by a series of closely spaced perforations formed in said first and second walls of said bag, and extending along a straight incline from an end of said arcuate transition segment towards the closer side edge of said bag;

(d) a second arcuate transition segment defined by a series of closely spaced perforations formed in said first and second walls of said bag, and beginning at an end of said diagonal segment and extending in an arcuate path towards the closer side edge of said bag; and (e) a horizontal segment defined by a series of closely spaced perforations formed in said first and second walls of said bag, and beginning at an end of said second arcuate transition segment and extending in a straight path towards the closer side edge of said bag;

whereby said vertical segment, first arcuate transition segment, diagonal segment, second arcuate transition segment, and horizontal segment cooperate to enable the corner portion of the bag to be torn in a progressive tearing motion to form a hole in the bag from which the contents can be poured.

2. A bag according to claim 1, wherein the arcuate transition segment of said tear line comprises less than 20 percent of the overall length of said tear line.

3. A bag according to claim 1, wherein said arcuate transition segment of said tear line defines a radius of approximately 2 inches.

4. A bag according to claim 1, wherein said first and second arcuate transition segments of said tear line each define a radius of approximately 1 inch.

5. A bag according to claim 1, wherein said diagonal segment of said tear line extends from said arcuate transition segment at an angle less than 60 degrees to said closer side edge.

6. A bag according to claim 1, wherein said diagonal segment of said tear line extends from said arcuate transition segment at a 45 degree angle to said closer side edge.

7. A bag according to claim 1, and comprising a second seal line spaced-apart from said first seal line and extending laterally from one side edge of said bag to the other, and further comprising a handle formed in an area between the two spaced-apart seal lines.

8. A bag according to claim 7, wherein said handle comprises a generally U-shaped, die-cut slit.

9. In a bag including first and second polyolefin walls with a thickness of between 3 and 12 mils and having joined opposing side edges, opposing end edges, and at least one seal line proximate one of said end edges and extending laterally from one side edge to the other for sealing closed an end of the bag, the improvement comprising a perforated tear line defining an easy-open corner portion of the bag removable to form a pourer, said perforated tear line comprising:

(a) a vertical segment defined by a series of closely spaced perforations formed in said first and second walls of said bag and closer to one side edge of said bag than the other, said vertical segment extending in a straight path outwardly from said seal line and generally parallel to the closer side edge of said bag;

(b) first arcuate transition segment defined by a series of closely spaced perforations formed in said first and second walls of said bag, and beginning at an end of said vertical segment and extending in an arcuate path towards the closer side edge of said bag; and (c) a diagonal segment defined by a series of closely spaced perforations formed in said first and second walls of said bag, and extending along a straight incline from an end of said arcuate transition segment towards the closer side edge of said bag;

(d) a second arcuate transition segment defined by a series of closely spaced perforations formed in said first and second walls of said bag, and beginning at an end of said diagonal segment and extending in an arcuate path towards the closer side edge of said bag; and (e) a horizontal segment defined by a series of closely spaced perforations formed in said first and second walls of said bag, and beginning at an end of said second arcuate transition segment and extending in a straight path towards the closer side edge of said bag;

whereby said vertical segment, first arcuate transition segment, diagonal segment, second arcuate transition segment, and horizontal segment cooperate to enable the corner portion of the bag to be torn in a progressive tearing motion to form a hole in the bag from which the contents can be poured.

10. A bag according to claim 9, wherein the perforations of said tear line are between 1/16th inch and 3/8th inch long.

11. A bag according to claim 9, wherein the perforations of said tear line are between 1/16th inch and 3/8th inch apart from adjacent perforations.

12. A bag according to claim 9, wherein said arcuate transition segment of said tear line comprises less than 20 percent of the overall length of said tear line.

13. A bag according to claim 9, wherein said arcuate transition segment of said tear line defines a radius of approximately 2 inches.

14. A bag according to claim 9, wherein said diagonal segment of said tear line extends from said arcuate transition segment at an angle less than 60 degrees to said closer side edge.

15. A bag according to claim 9, wherein said diagonal segment of said tear line extends from said arcuate transition segment at a 45 degree angle to said closer side edge.

16. A bag according to claim 9, wherein said first and second arcuate transition segments of said tear line each define a radius of approximately 1 inch.

* * * * *